US010494779B2

(12) United States Patent
Dagher et al.

(10) Patent No.: US 10,494,779 B2
(45) Date of Patent: Dec. 3, 2019

(54) HYBRID COMPOSITE CONCRETE BRIDGE AND METHOD OF ASSEMBLING

(71) Applicant: University of Maine System Board of Trustees, Orono, ME (US)

(72) Inventors: Habib J. Dagher, Veazie, ME (US); James M. Anderson, Hampden, ME (US); William G. Davids, Bangor, ME (US); Joshua D. Clapp, Veazie, ME (US)

(73) Assignee: University of Maine System Board of Trustees, Orono, ME (US)

( * ) Notice: Subject to any disclaimer, the term of this patent is extended or adjusted under 35 U.S.C. 154(b) by 0 days.

(21) Appl. No.: 16/299,825

(22) Filed: Mar. 12, 2019

(65) Prior Publication Data

US 2019/0276994 A1 Sep. 12, 2019

Related U.S. Application Data

(60) Provisional application No. 62/641,562, filed on Mar. 12, 2018.

(51) Int. Cl.

| | |
|---|---|
| ***E01D 2/00*** | (2006.01) |
| ***E04C 3/29*** | (2006.01) |
| ***E04C 3/28*** | (2006.01) |
| *E01D 19/12* | (2006.01) |
| *E01D 21/00* | (2006.01) |
| *E01D 101/26* | (2006.01) |
| *E01D 101/40* | (2006.01) |

(52) U.S. Cl.

CPC ..... *E01D 2/00* (2013.01); *E04C 3/28* (2013.01); *E04C 3/291* (2013.01); *E01D 19/125* (2013.01); *E01D 21/00* (2013.01); *E01D 2101/26* (2013.01); *E01D 2101/40* (2013.01)

(58) Field of Classification Search

CPC ..... E01D 2/00; E01D 19/125; E01D 21/00; E01D 2101/26; E01D 2101/40; E04C 3/291

USPC ..... 14/73, 74.5, 77.1, 78

See application file for complete search history.

(56) References Cited

U.S. PATENT DOCUMENTS 4,129,917 A * 12/1978 Sivachenko ..... E01D 2/04 14/6
4,912,764 A * 3/1990 Hartwell ..... G10L 19/10 704/207
5,966,764 A * 10/1999 Vodicka ..... E01D 2/00 14/74.5

(Continued)

FOREIGN PATENT DOCUMENTS

WO 2009131284 A1 10/2009

OTHER PUBLICATIONS

Rajchel, et al., "Hybrid Bridge Structures Made of FRP Composite and Concrete", Civil and Environmental Engineering Reports, (2017), Issue No. 2080-5187, pp. 162-169.

(Continued)

*Primary Examiner* — Raymond W Addie

(74) *Attorney, Agent, or Firm* — MacMillan, Sobanski & Todd, LLC

(57) ABSTRACT

An elongated girder for use in a bridge includes a girder body having a modified V-shaped cross section. The body includes longitudinally extending webs defining sides of the girder, a bottom flange extending between the webs, and top flanges extending outwardly from the webs.

22 Claims, 11 Drawing Sheets

(56) References Cited

U.S. PATENT DOCUMENTS

| | | | | |
|---|---|---|---|---|
| 6,081,955 | A * | 7/2000 | Dumlao | B63B 5/24 14/73 |
| 7,861,346 | B2 * | 1/2011 | Wilson | E01D 19/125 14/24 |
| 8,671,490 | B1 * | 3/2014 | Carney | B66C 19/005 14/77.1 |
| 9,915,045 | B1 * | 3/2018 | Azizinamini | E01D 2/00 |
| 2005/0262651 | A1 * | 12/2005 | Snead | E01D 22/00 14/77.1 |
| 2006/0265819 | A1 * | 11/2006 | Azizinamini | E01D 2/00 14/74.5 |
| 2008/0301889 | A1 * | 12/2008 | Kang | B66C 17/06 14/77.1 |
| 2013/0061406 | A1 * | 3/2013 | Southworth | E01D 19/125 14/73 |

OTHER PUBLICATIONS

Williams, "The Ongoing Evolution of FRP Bridges", Public Roads, (2008), Publication No. FHWA-HRT-08-006, vol. 72, No. 2.
EP Search Report, Application No. 19162378.4, dated Jul. 26, 2019.

* cited by examiner

HYBRID COMPOSITE CONCRETE BRIDGE AND METHOD OF ASSEMBLING

BACKGROUND

This invention relates in general to bridges having precast or Cast-In-Place (CIP) concrete deck panels. In particular, this invention relates to embodiments of improved girders for use in bridges having precast or CIP concrete decks and an improved system for assembling a bridge comprising the improved girders and precast or CIP concrete deck panels.

Known bridges that are assembled using precast or CIP concrete deck panels typically use girders formed from steel, reinforced concrete, or pre-stressed concrete that are relatively heavy. For example, a typical 40 ft bridge steel girder may weigh about 3,440 lbs, and a typical 40 ft concrete double-T girder may weigh about 40,120 lbs. For example, to assemble one four-span, two-lane bridge with such steel or concrete girders, requires multiple trucks to move the girders to a bridge site, and involves mobilizing large, expensive cranes with a high load capacity at the bridge site.

It is therefore desirable to provide improved girders for use in bridges having precast or CIP concrete decks that are lighter, stackable, and therefore easier to move and assemble than known girders.

SUMMARY OF THE INVENTION

This invention relates to improved girders for use in bridges having precast or CIP concrete decks that are lighter, stackable, and therefore easier to move and assemble than known girders. In one embodiment, an elongated girder for use in a bridge includes a girder body having a modified V-shaped cross section. The body includes longitudinally extending webs defining sides of the girder, a bottom flange extending between the webs, and top flanges extending outwardly from the webs.

Various aspects of this invention will become apparent to those skilled in the art from the following detailed description of the preferred embodiment, when read in light of the accompanying drawings.

DETAILED DESCRIPTION OF THE INVENTION

Figure 1:
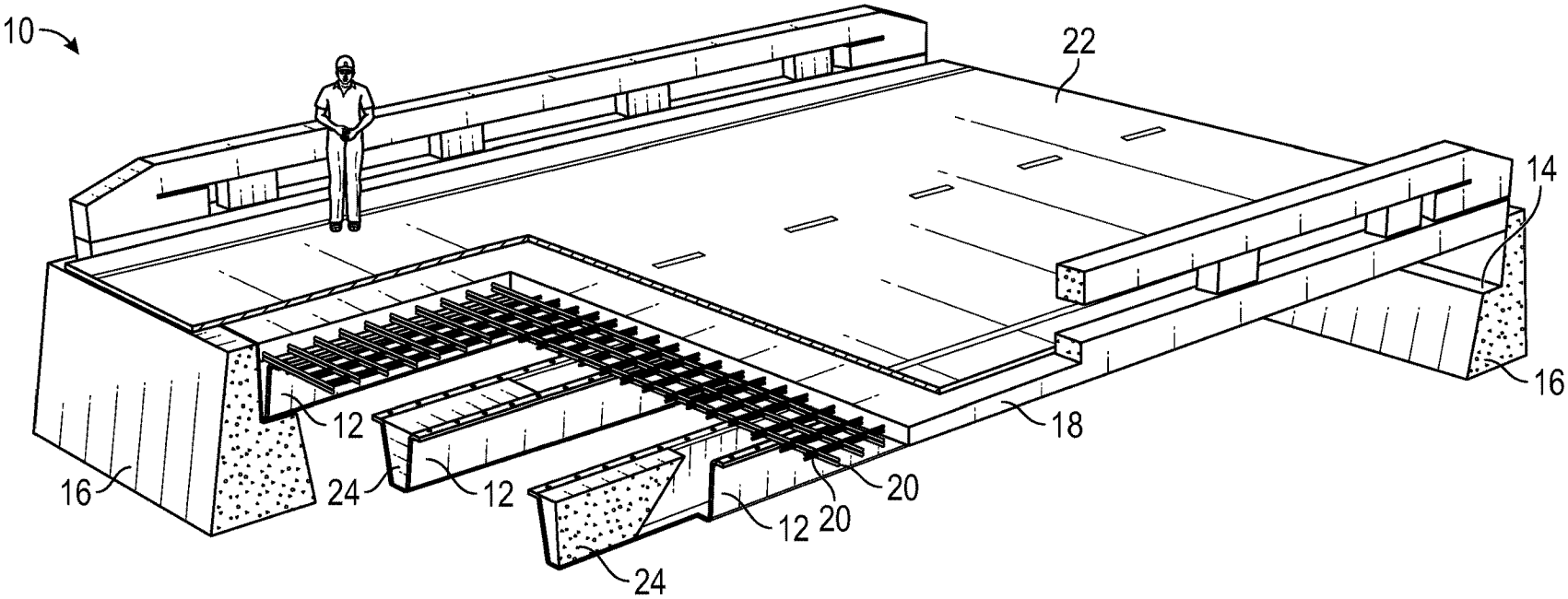
FIG. 1 is a perspective view of a bridge assembled with improved hybrid composite girders and a concrete deck according to this invention.

Referring now to FIG. 1, there is illustrated a first embodiment of a bridge 10 assembled with a plurality of improved elongated hybrid composite girders 12 according to this invention. In the illustrated bridge 10, the girders 12 extend between seats 14 formed in conventional bridge abutments 16. A Cast-In-Place (CIP) concrete deck 18 is shown formed on the plurality of girders 12. The illustrated CIP concrete deck 18 includes a plurality of conventional reinforcing bars or rebar 20 formed therein. Paving material 22, such as asphalt is shown applied over the concrete deck 18. It will be understood that the bridge 10 may also be formed with a plurality of precast concrete deck panels P1, P2, and P3 (not shown in FIG. 1, but see FIGS. 9 through 16) rather than the CIP concrete deck 18.

If desired, an interior of the girder 12 at the distal ends 11A and 11B of the girder body 11 may be filled with a material 24, such as concrete to strengthen the distal ends 11A and 11B of the girder body 11 to prevent crippling of the girder 12 at the bridge abutments 16. Alternatively, a plate (not shown) of solid composite material, such as, but not limited to FRP may be installed in the interior of the girder 12 at the distal ends 11A and 11B of the girder body 11, extend between the bottom flange 30 and the top flanges 32 and 34, and affixed to the webs 26 and 28 in a plane substantially perpendicular to a longitudinal axis of the girder 12. The plate (not shown) may have solid construction or may have one or more openings therethrough. Further, a truss-type brace (not shown) may be installed in the interior of the girder 12 at the distal ends 11A and 11B of the girder body 11 between the webs 26 and 28.

In conventional bridge construction for two-lane bridges, approximately four girders are placed between bridge abutments. The bridge deck is then supported on the bridge girders. The girders are typically placed about 6 ft to 7 ft apart. Concrete deck panels, such as the panels P1, P2, and P3, are then positioned perpendicularly to the girders and attached thereto. Alternatively, a concrete deck may be cast in place over the girders. A length of the deck members is typically equal to a width of the bridge.

For a single-span two-lane bridge, the girders have a length about equal to the length of the bridge to be constructed. The precast reinforced concrete deck panels may have a length equal to a width of the bridge such as about 30 ft, or half the width of the bridge such as about 15 ft, and a width within the range of about 4 ft to about 8 ft. For multi-span bridges, the girders typically have a length equal to a length of each span. CIP decks, such as the concrete deck 18, may be placed over temporary, i.e., removable, or stay-in-place formwork spanning between and/or over the girders 12.

Figure 2:
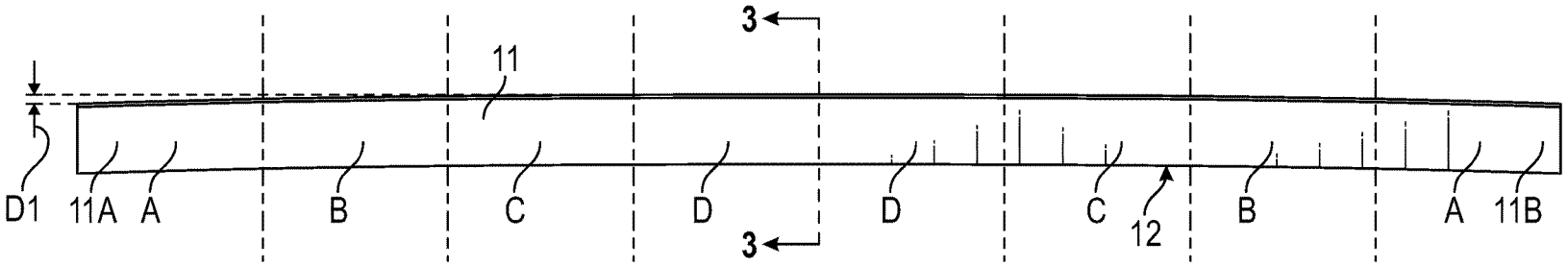
FIG. 2 is a side elevational view of the hybrid composite girder illustrated in FIG. 1.
Figure 3:
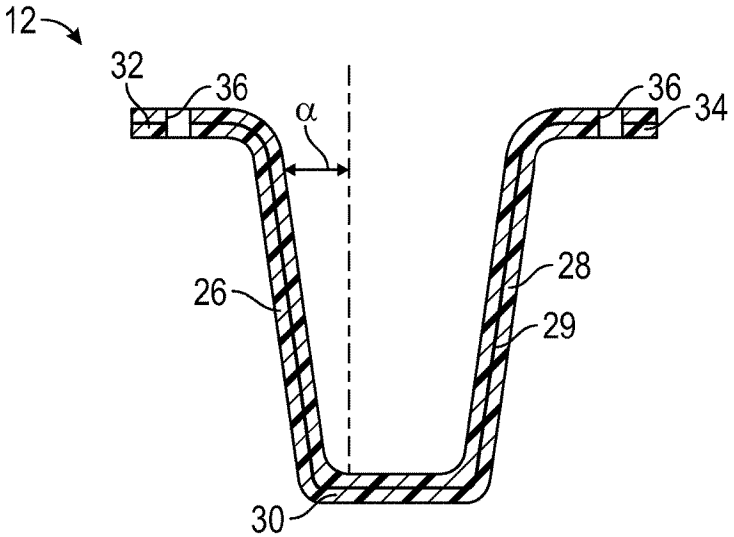
FIG. 3 is a cross-sectional view taken along the line 3-3 of FIG. 2.

As shown in FIGS. 1 through 3, the hybrid composite girder 12 according to this invention has an elongated girder body 11 defining first and second distal ends 11A and 11B. The girder body 11 has a modified V-shape when viewed in cross-section. The girder body 11 further includes longitudinally extending webs 26 and 28 defining sides of the girder 12, a bottom flange 30 extending between the webs 26 and 28, and top flanges 32 and 34 extending outwardly from the webs 26 and 28, respectively. The top flanges 32 and 34 are substantially parallel with the bottom flange 30. A plurality of apertures 36 are formed through each of the top flanges 32 and 34.

The bottom flange 30 and the top flanges 32 and 34 are preferably formed from solid composite fiber reinforced polymer (FRP) material. The webs 26 and 28 preferably have a sandwich type construction and are formed from a layer of lightweight core material 29 (shown schematically in FIG. 3) such as a foam material, positioned between two layers of solid composite material, such as, but not limited to FRP, skins. The core material 29 may be formed from any desired material, including, but not limited to foam and balsa. The core material 29 may have any desired thickness that will vary based on a length of the span of the bridge in which the hybrid composite girders 12 will be used. Alternatively, the core material 29 may be thicker in a central portion of the hybrid composite girder 12 and thinner towards the distal ends 11A and 11B of the girder body 11. If desired, the hybrid composite girder 12 may have no core material 29 at the distal ends 11A and 11B of the girder body 11 but have core material 29 over the interior portions of the span of the girder 12.

To minimize weight, the thicknesses of the webs 26 and 28 and the bottom flange 30 will preferably vary in a stepwise manner along the girder span. The thickness of the bottom flange 30 increases mostly stepwise towards mid-span of the girder and the thickness of the webs 26 and 28 increase stepwise towards the ends of the girder. This is illustrated using typical dimensions for an exemplary 42 ft girder in FIG. 2.

FIG. 2 illustrates one example of the hybrid composite girder 12 having a length of 42.0 ft. Preferably, the top flanges 32 and 34 are formed from glass FRP and have a thickness of about 1.0 in, but this thickness may vary based on a span length of the bridge, and may further vary based on the type of bridge deck, i.e., a deck formed from reinforced concrete deck panels P1, P2, and P3, or the CIP deck 18. Further, the top flanges 32 and 34 are preferably formed to have a bolt bearing strength sufficient to achieve composite action between the FRP top flanges 32 and 34 and the concrete deck, i.e., the reinforced concrete deck panels P1, P2, and P3, or the CIP deck 18. If desired, the top flanges 32 and 34 may be formed to have a bolt bearing strength that is at least equal to a shear strength of the steel bolts. Additionally, the top flanges 32 and 34 are preferably formed to further have a combined bolt bearing strength that is at least equal to a compressive strength of the plurality of reinforced concrete deck panels P1, P2, and P3.

As shown in FIG. 2, the 42.0 ft hybrid composite girder 12 will preferably have a camber D1 when used with bridges built on sections of roadway with a constant grade, and when not loaded. Sections of the hybrid composite girder 12, indicated by the letters A through D in FIG. 2, will preferably have different thicknesses for the webs 26 and 28 and the bottom flange 30. One non-limiting example of a thickness for the webs 26 and 28 and the bottom flange 30 in each of the sections A through D of the exemplary 42.0 ft girder is shown in Table 1. It will be understood that these thicknesses may vary based on a span length of the bridge, and may further vary based on the type of bridge deck, i.e., a deck formed from reinforced concrete deck panels P1, P2, and P3, or the CIP deck 18.

TABLE 1

COMPOSITE GIRDER DIMENSIONS

| GIRDER SECTION | LENGTH | WEB THICKNESS | BOTTOM FLANGE THICKNESS |
|---|---|---|---|
| A | about 6.0 ft | about 1.80 | about 0.50 |
| B | about 5.0 ft | about 1.80 | about 0.70 |
| C | about 5.0 ft | about 1.75 | about 0.75 |
| D | about 5.0 ft | about 1.70 | about 0.75 |

Figure 4:
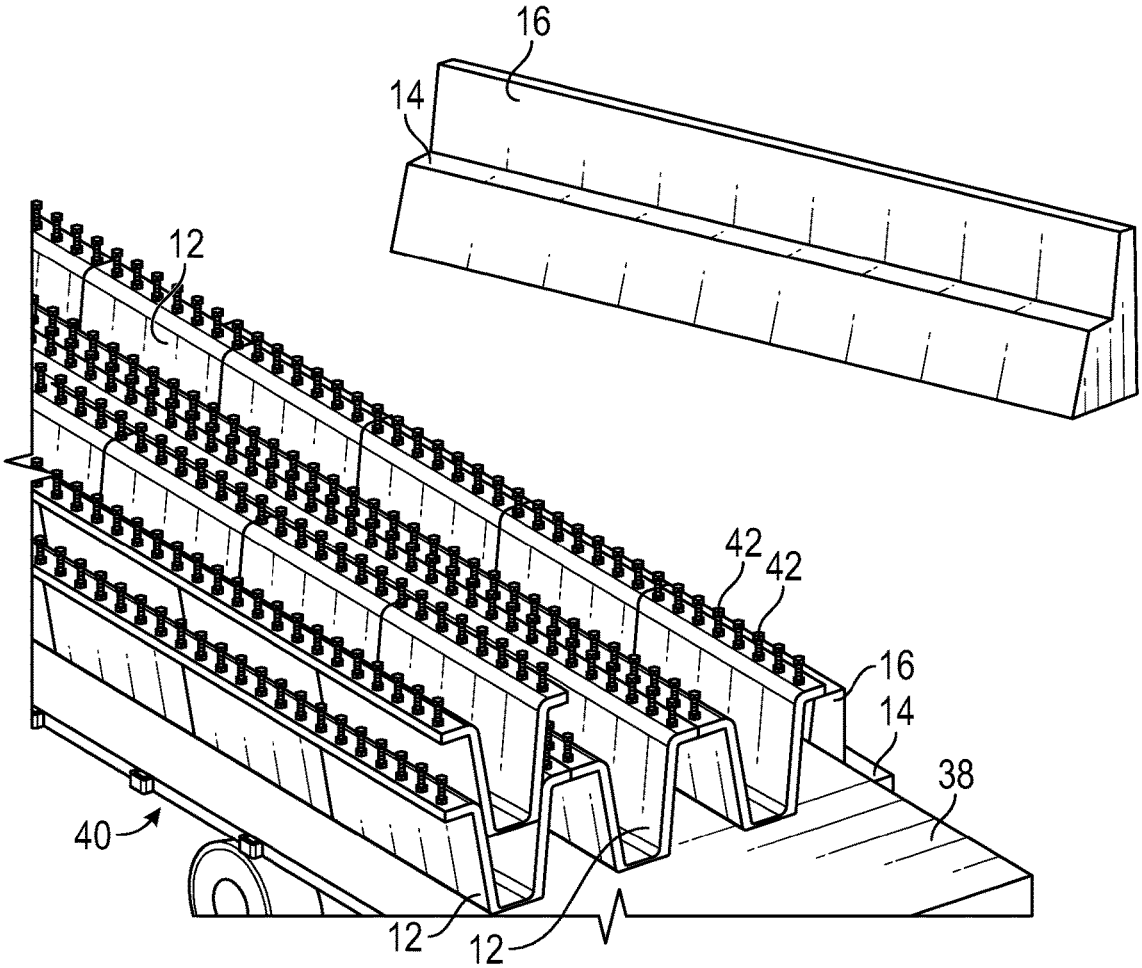
FIG. 4 is a perspective view of a plurality of the hybrid composite girders illustrated in FIGS. 1 through 3 stacked on a truck bed at a bridge construction site showing the bridge support abutments.

FIG. 4 illustrates the bed 38 of a truck 40. A plurality of the hybrid composite girders 12 are stacked and nested on the truck bed 38. The hybrid composite girders 12 are positioned near two bridge abutments 16 upon which the hybrid composite girders 12 will be mounted. As shown in FIG. 4, the top flanges 32 and 34 may include a plurality of outwardly extending (upwardly extending when viewing FIG. 4) steel shear connectors 42, such as steel bolts, each mounted in an aperture 36 and each having a length of about 4.0 in above an upper surface of the top flanges 32 and 34 (the upwardly facing surfaces when viewing FIG. 4).

It will be understood that within the assembled bridge 10, shear transfer from the reinforced concrete deck panels P1, P2, and P3, or the CIP deck 18, to the elongated girders 12 occurs through the top flanges 32 and 23 of the elongated girders 12. The top surface of the top flanges 32 and 34 (the upwardly facing surface when viewing FIGS. 1 through 3) may be smooth or intentionally roughened to promote shear transfer between the girder 12 and the concrete deck panels P1, P2, and P3 or the CIP deck 18 formed thereon as described below. Additionally, a combination of the smooth surface or the roughened surface and a clamping force from the steel bolts 42 promotes shear transfer between each girder 12 and the concrete deck panels P1, P2, and P3.

Figure 17:
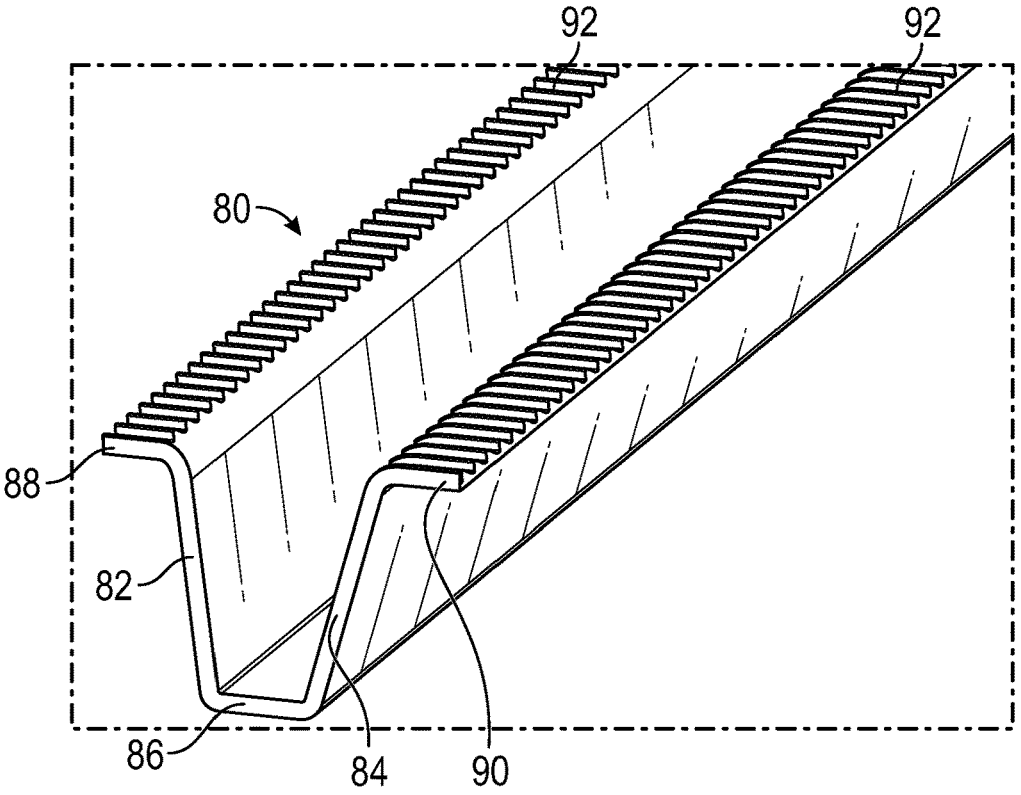
FIG. 17 is a perspective view of an alternate embodiment of the hybrid composite girder illustrated in FIGS. 1 through 4.
Figure 18:
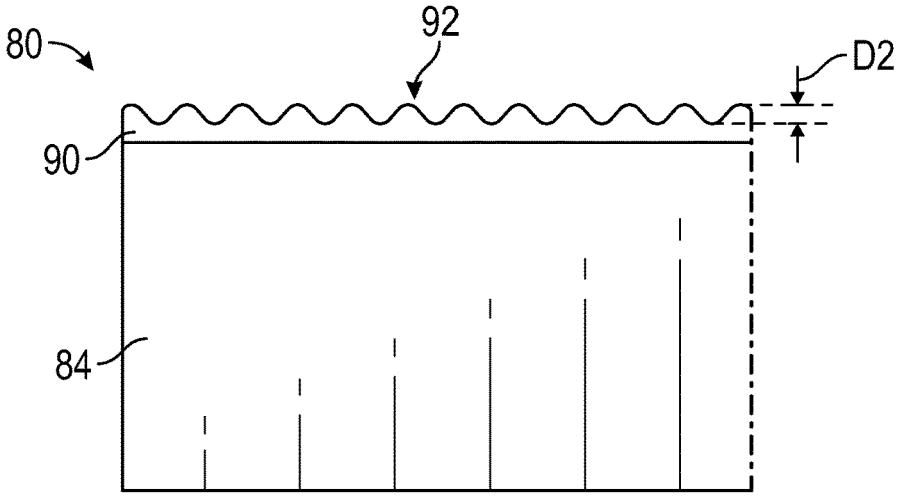
FIG. 18 is a side elevational view of a portion of the hybrid composite girder illustrated in FIG. 17.

An alternate embodiment of the hybrid composite girder is shown at 80 in FIGS. 17 and 18. The hybrid composite girder 80 has the modified V-shape when viewed in cross-section and includes longitudinally extending webs 82 and 84 defining sides of the girder 80, a bottom flange 86 extending between the webs 82 and 84, and top flanges 88 and 90 extending outwardly from the webs 82 and 84, respectively. The top flanges 88 and 90 are substantially parallel with the bottom flange 86. A plurality of apertures (not shown in FIGS. 17 and 18, but substantially similar to the apertures 36 shown in FIG. 3) may be formed through each of the top flanges 88 and 90. A top surface 92 of the top flanges 88 and 90 (the upwardly facing surface when viewing FIGS. 17 and 18) has a corrugated surface contour. This corrugated surface 92 also promotes shear transfer between the girder 80 and the concrete deck panels P1, P2, and P3 or the CIP deck 18 formed thereon as described below. Additionally, a combination of the corrugated surface 92 and a clamping force from the steel bolts 42 promotes shear transfer between each girder 12 and the concrete deck panels P1, P2, and P3.

The illustrated corrugations have a depth D2 of about 0.25 inches. Alternatively, the depth D2 of the corrugations may vary based on factors including, but not limited to, the size of the hybrid composite girder 80 and a desired value of shear transfer between each girder 80 and the concrete deck panels P1, P2, and P3.

Figure 5:
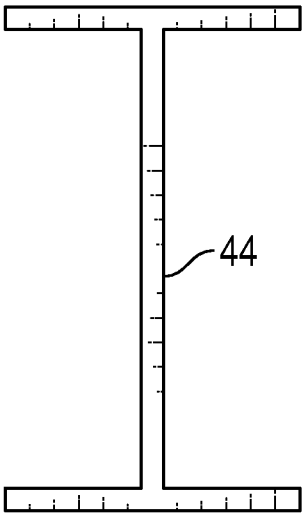
FIG. 5 (Prior Art)
FIG. 5 is an end view of a known steel I-beam girder.
Figure 6:
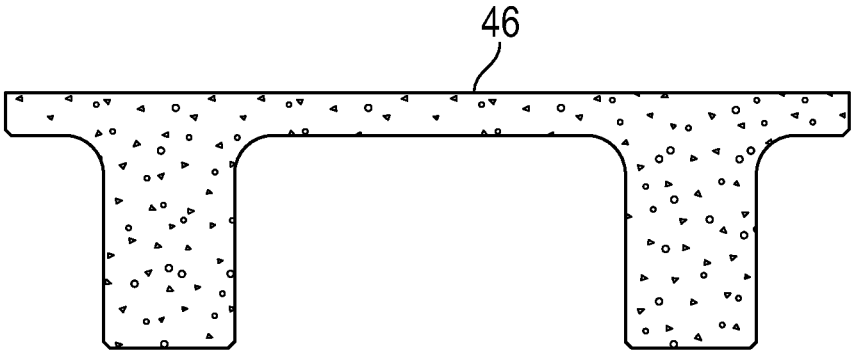
FIG. 6 (Prior Art)
FIG. 6 is an end view of a known steel double-T girder.

Advantageously, each hybrid composite hybrid composite girder 12 has a significantly lower weight than a conventional girder of the same length. As shown in Table 2, a 40.0 ft hybrid composite hybrid composite girder 12 has a weight of about 1,323 lbs. A 40.0 ft conventional steel I-beam girder 44 (see FIG. 5) weighs about 3,440 lbs, and a 40.0 ft conventional reinforced concrete double-T girder 46 (see FIG. 6) weighs about 40,120 lbs.

TABLE 2

BRIDGE DESIGN PARAMETERS

| PARAMETER | COMPOSITE GIRDER 12 | I-BEAM GIRDER 44 | DOUBLE-T GIRDER 46 |
|---|---|---|---|
| SPAN (FT) | 40 | 40 | 40 |
| TOTAL WIDTH (FT) | 30 | 30 | 32 |
| NO. OF GIRDERS | 4 | 4 | 4 |
| GIRDER SPACING (FT) | 7.5 | 7.5 | 8 |
| GIRDER WEIGHT (LBS) | 1,323 | 3,440 | 40,120 |

As best shown in FIG. 3, each of the webs 26 and 28 are formed at an acute angle α from a line L1 that extends perpendicularly (vertically when viewing FIG. 3) from the bottom flange 30. The angle α will vary based on factors including, but not limited to, the size of the hybrid composite girder 12. Further, each hybrid composite girder 12 is formed such that inside surfaces of the webs 26 and 28 and the bottom flange 30 are smooth such that they have substantially no obstructions extending outwardly therefrom.

Figure 7A:
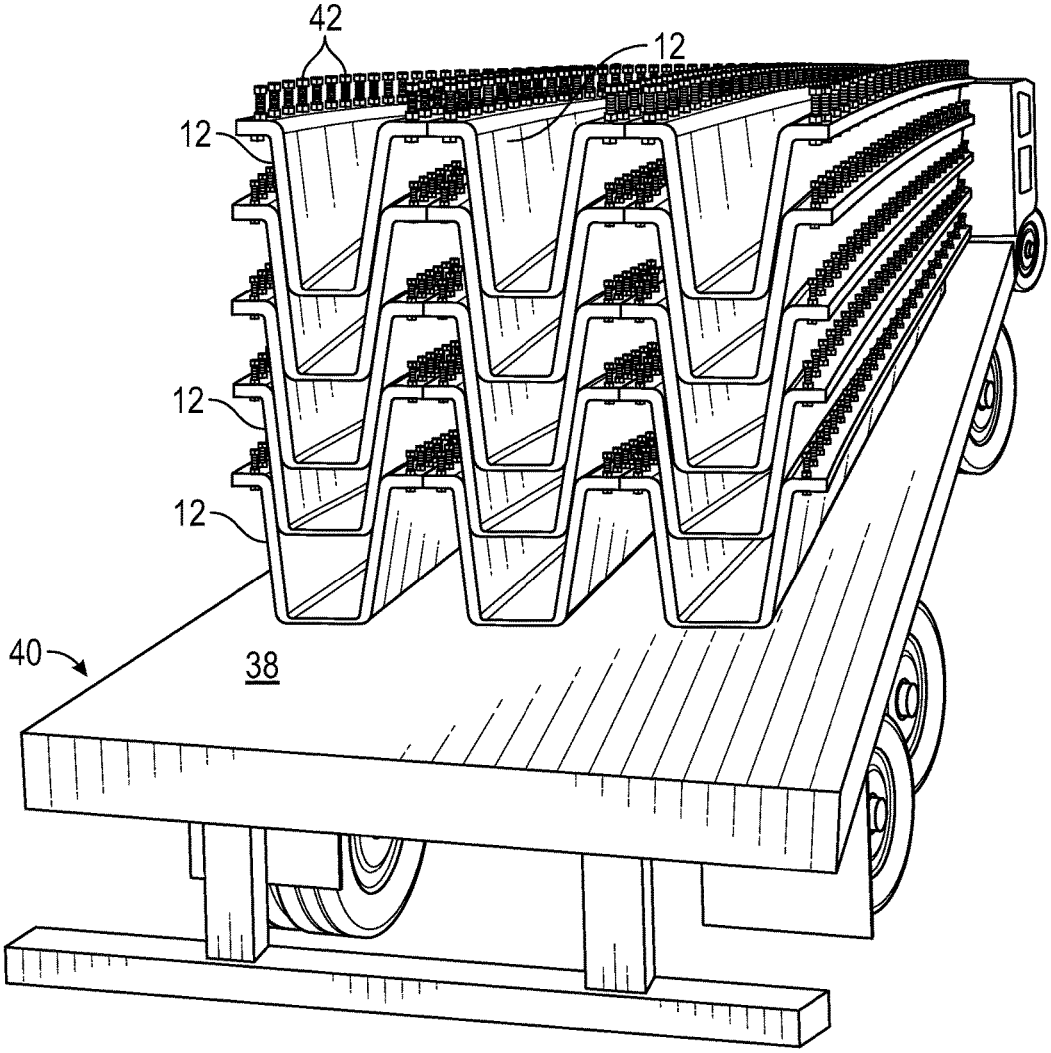
FIG. 7A is a perspective view of a plurality of the hybrid composite girders illustrated in FIGS. 1 through 4 stacked and nested on a truck bed.
Figure 7B:
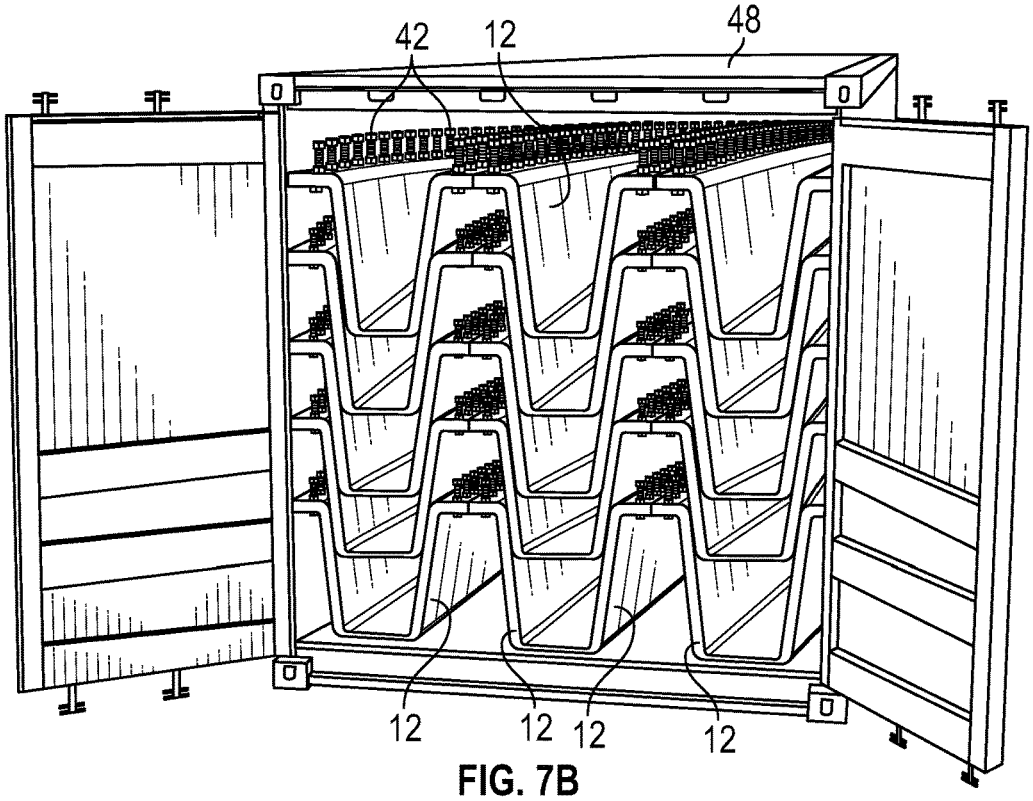
FIG. 7B is a perspective view of the plurality of the hybrid composite girders illustrated in FIG. 7B shown stacked and nested in a shipping container.
Figure 15:
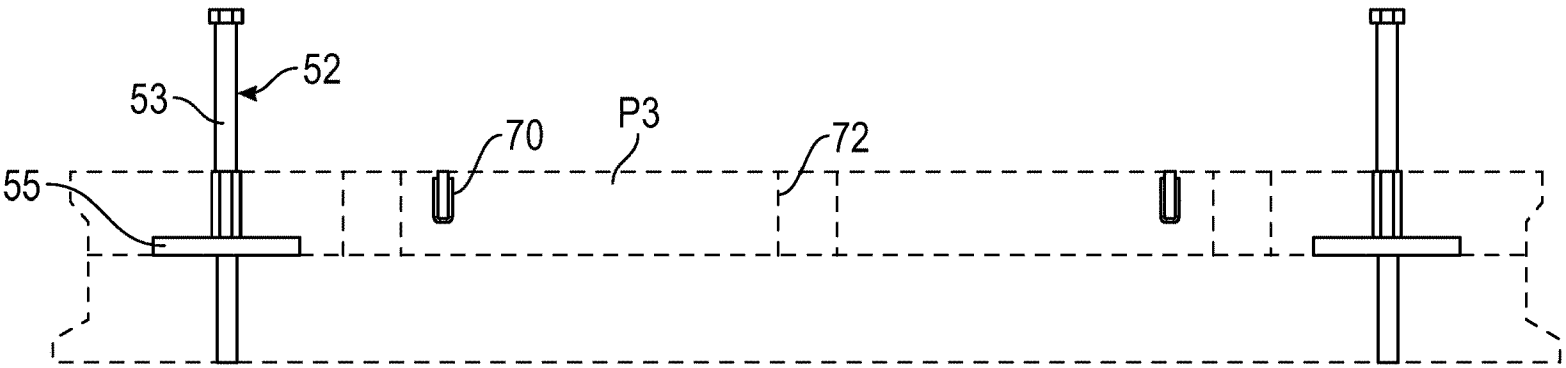
FIG. 15 is an end view of the deck panel illustrated in FIG. 14.

Advantageously, because of the combination of these features, i.e., the significantly reduced weight of the hybrid composite girders 12 relative to the conventional steel I-beam girder 44 and the conventional reinforced concrete double-T girder 46 as shown in Table 2, and the angle α from the vertical line L1 at which the webs 26 and 28 are formed (which thus defines the modified V-shaped cross-section of the hybrid composite girder 12) that allows for nesting, transportation costs may be significantly reduced. For example, as shown in FIG. 7A, 15 of the 40.0 ft span hybrid composite girders 12 may be nested and carried on one flatbed truck 40. Alternatively, as shown in FIG. 7B, the same 15 of the 40.0 ft span hybrid composite girders 12 may be nested and carried within one standard shipping container 48.

Advantageously, the illustrated 15 hybrid composite girders 12 are enough to assemble three to four bridges and collectively weigh only about 19,845 lbs. In contrast, 15 of the 40.0 ft span steel I-beam girders 44 weigh about 51,600 lbs and will require at least two trucks to move. In further contrast, 15 of the 40.0 ft span reinforced concrete double-T girders 46 weigh about 601,800 lbs and will require at least 15 trucks to move, i.e., each 40.0 ft span reinforced concrete double-T girder 46 requires one truck to move.

Figure 8:
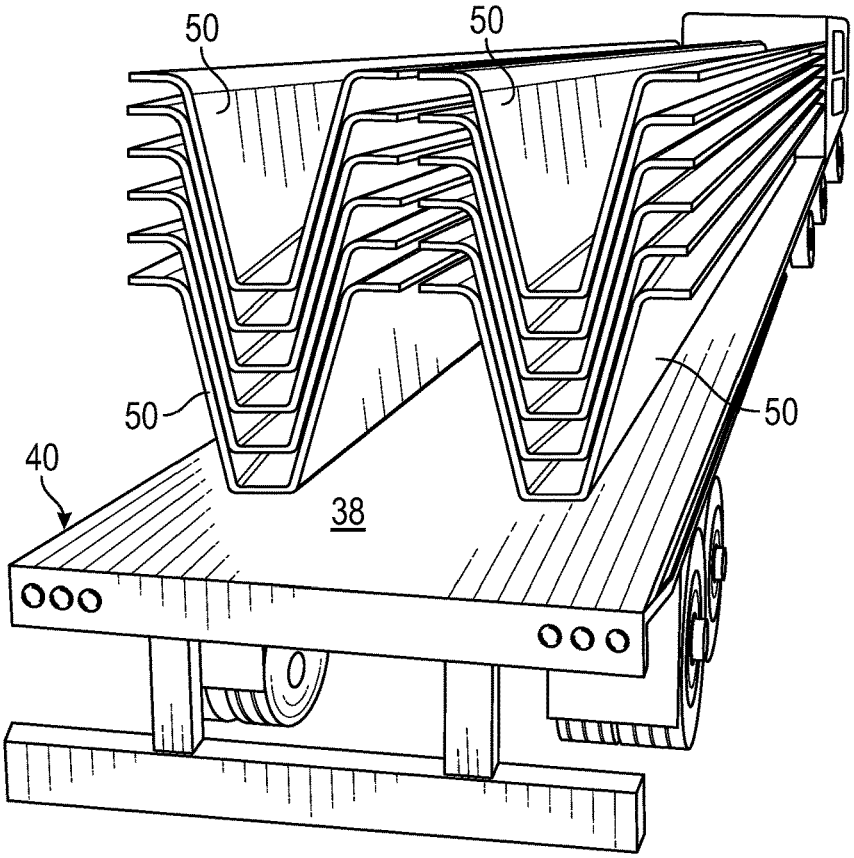
FIG. 8 is a perspective view of a plurality of an alternate embodiment of the hybrid composite girders illustrated in FIGS. 7A and 7B shown stacked and nested on a truck bed.

The efficiencies realized in moving a plurality of a 70.0 ft span embodiment of the hybrid composite girders 50 is even greater. For example, as shown in FIG. 8, up to 16 of the 70.0 ft span hybrid composite girders 50 may be nested and carried on one flatbed truck 40, although for illustrative purposes, only 12 of the 70.0 ft span hybrid composite girders 50 are shown nested and carried on the flatbed truck 40.

Advantageously, the 16 hybrid composite girders 50 are enough to assemble four bridges and collectively weigh only about 42,496 lbs, or about 2,656 lbs each. In contrast, 16 of a 70.0 ft embodiment of the steel I-beam girders 44 weigh about 151,200 lbs, or about 9,450 lbs each, and will require at least four trucks to move. Further, a 70 ft span embodiment of the concrete double-T girder 46 weighs about 70,210 lbs. Thus, as with the 40.0 ft span reinforced concrete double-T girders 46, each 70 ft span embodiment of the concrete double-T girder 46 will require one truck to move.

Once the required number of hybrid composite girders 12 arrive at the site of a bridge 10 to be assembled, the bridge 10 may be assembled in minimal time, such as in one day or less, and with minimal, economical, and readily available equipment. For example, a bridge 10 comprising a plurality of the hybrid composite girders 12 according to the invention may be assembled with one locally available conventional crane truck or one locally available conventional deck crane. It will be understood that any suitable conventional crane truck and any suitable conventional deck crane may be used. Advantageously, such conventional crane trucks and conventional deck cranes are typically commercially available from an equipment rental firm, thus allowing a required crane truck and/or a required deck crane to be rented only for the short duration of the bridge assembly, such as one day, eliminating the cost of mobilizing and operating a large crane.

If desired, the top flanges 32 and 34 may be braced together with X-bracing in a substantially horizontal plane.

Figure 9:
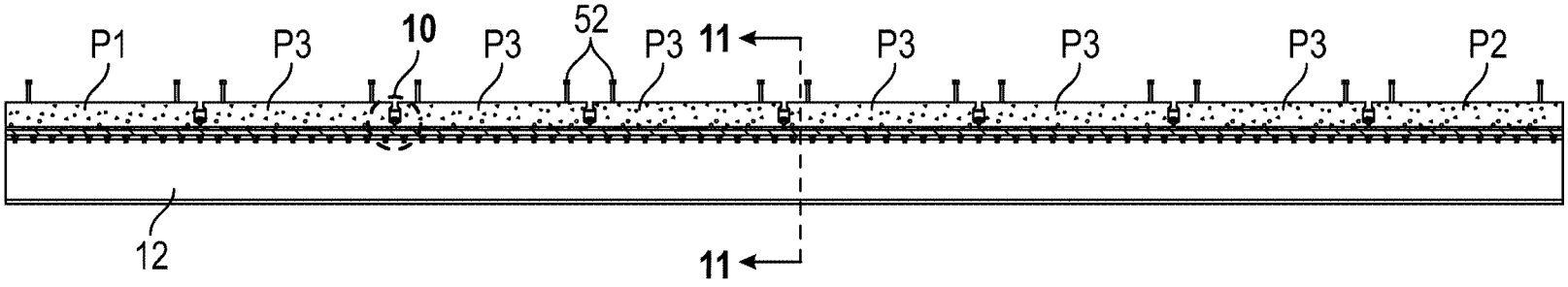
FIG. 9 is a side elevational view of a portion of a bridge assembled with improved hybrid composite girders and a concrete deck according to this invention.

FIG. 9 is a side elevational view, in cross-section, of an embodiment of the bridge 10 assembled with a plurality of the hybrid composite girders 12 and precast, reinforced concrete deck panels P1, P2, and P3 mounted to the hybrid composite girders 12. In the illustrated embodiment, a deck panel P1 is positioned at one distal end of the bridge span (the left end when viewing FIG. 9). A deck panel P2 is similar to the deck panel P1, such as a mirror image thereof, and is positioned at an opposite distal end of the bridge span (the right end when viewing FIG. 9). Deck panels P3 are positioned between the deck panels P1 and P2. Each of the deck panels P1, P2, and P3 may include one or more conventional leveling mechanisms 52 to align and level the individual deck panels P1, P2, and P3.

Figure 10:
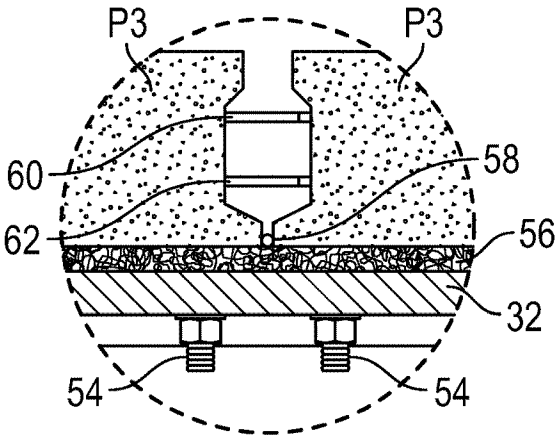
FIG. 10 is an enlarged view of a portion of the bridge shown in FIG. 9.
Figure 11:
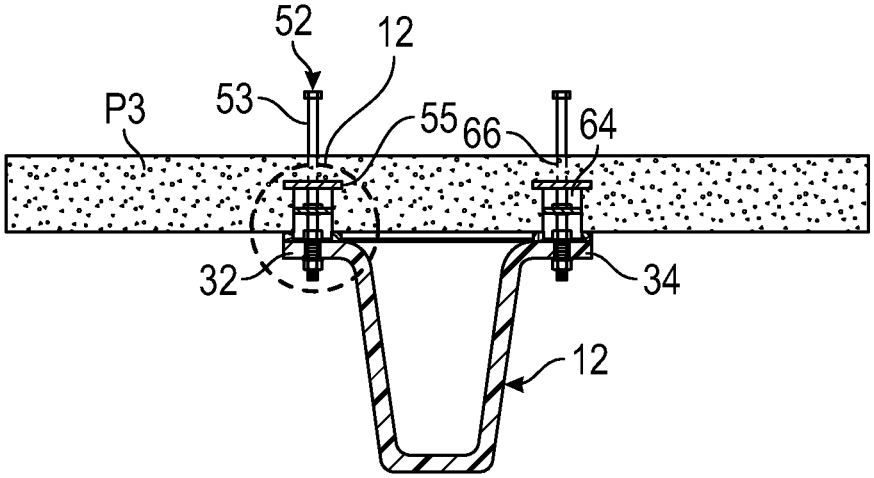
FIG. 11 is a cross-sectional view taken along the line 11-11 of FIG. 9.
Figure 12:
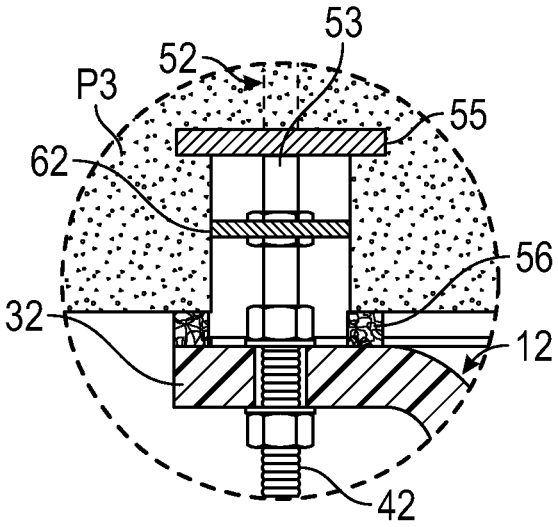
FIG. 12 is an enlarged view of a portion of the bridge shown in FIG. 11.
Figure 13:
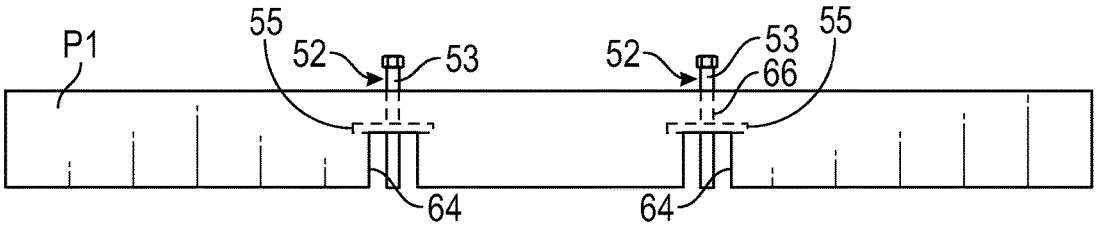
FIG. 13 a side elevational view of a first embodiment of a deck panel according to this invention.

As shown in FIG. 10 adjacent deck panels P2 may be separated by a foam backing rod 58. Sections of rebar 60 and 62 are shown extending outward of the deck panels P3. The deck panels P3 may further be attached to the top flanges 32 and 34 by a plurality of threaded fasteners 54 that extend through the top flanges 32 and 34. If desired, a layer of caulking 56, such as a foam haunch sealant may be applied to the upwardly facing surfaces of the top flanges 32 and 34 prior to positioning the reinforced concrete deck panels P1, P2, and P3 thereon.

The precast concrete deck panels P1, P2, and P3 further include pairs of parallel channels 64 in a lower surface thereof. The deck panels P1, P2, and P3 may be positioned on the hybrid composite girders 12 such that the shear connectors 42 on each of the top flanges 32 and 34 are positioned inside one of the channels 64. Each channel 64 may include one or more access bore 66 extending from the channels 34 to an upper surface of the deck panels P1, P2, and P3. As shown in FIGS. 11 through 16, each deck panel P1, P2, and P3 may include a plurality of conventional leveling mechanisms 52 to align and level the individual deck panels P1, P2, and P3. The illustrated leveling mechanisms 52 include a leveling bolt 53 and a threaded plate 55. Once the reinforced concrete deck panels P1, P2, and P3 are attached to the hybrid composite girders 12, concrete grout (not shown) may be applied through the access bores 72 to fill the channels 64 around the steel bolts 42 to further secure the deck panels P1, P2, and P3 to the hybrid composite girders 12 when the grout is cured.

Figure 14:
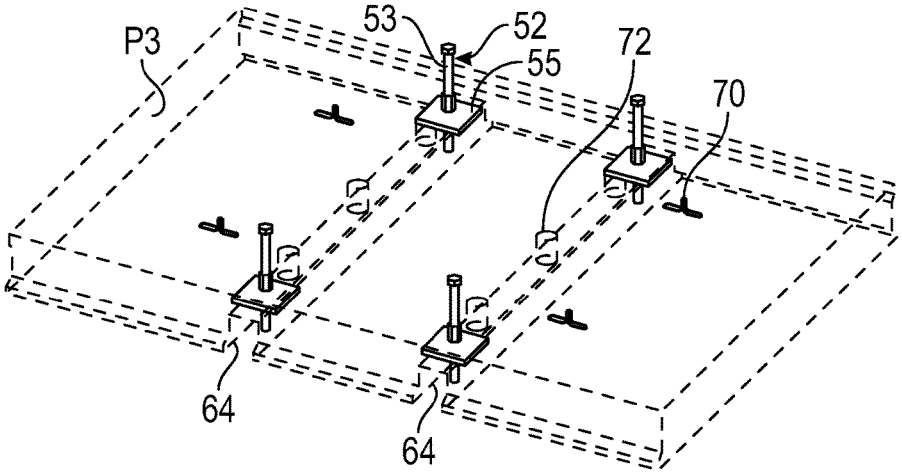
FIG. 14 is a perspective view of a second embodiment of a deck panel according to this invention.
Figure 16:
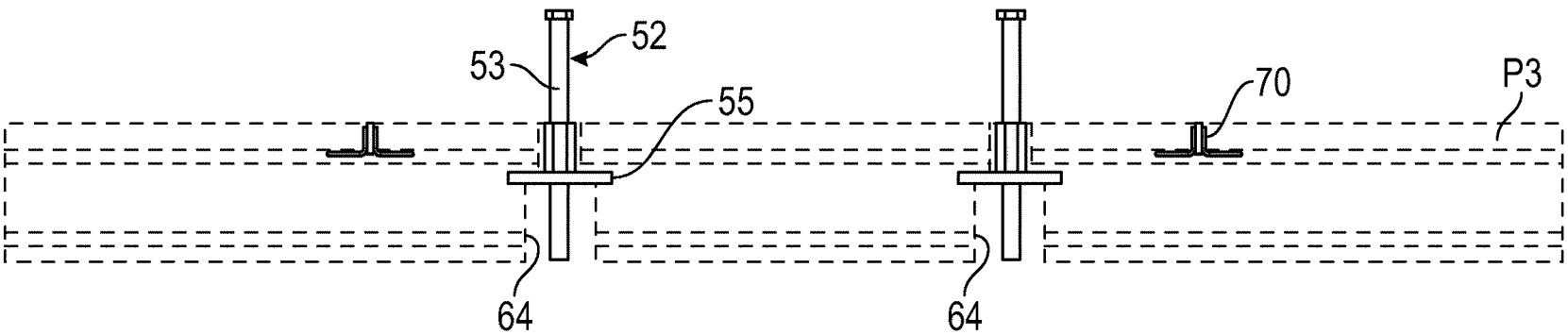
FIG. 16 is a side view of the deck panel illustrated in FIGS. 14 and 15.

As shown in FIGS. 14 through 16, the deck panel P3 includes a lifting point 70. Each of the deck panels P1 and P2 may also have the lifting point 70.

Advantageously, when the concrete deck panels P1, P2, and P3 are attached to the girders 12, no portion of the concrete deck panels P1, P2, and P3 extend below the top flanges 32 and 34. Additionally, the concrete grout within the parallel channels 64 and about the shear connectors 42 therein, further secure the concrete deck panels P1, P2, and P3 to the elongated girders 12, such that the bridge system 12 is capable of supporting a weight of the concrete deck panels P1, P2, and P3 prior to the concrete grout within the parallel channels 64 being fully cured.

Alternatively, in lieu of the precast concrete deck panels P1, P2, and P3, a CIP deck may be formed over the hybrid composite girders 12. The CIP deck, such as the CIP concrete deck 18 shown in FIG. 1, may be cast over conventional removable or stay-in-place formwork (not shown) spanning between the hybrid composite girders 12.

The hybrid composite girders 12, shear connectors 42, reinforced (CIP) concrete deck 18 (or alternatively, the precast concrete deck panels P1, P2, and P3) according to this invention define a hybrid composite concrete bridge system, such as shown at 10 in FIG. 1, that can be assembled with lower logistics, faster, and with a lower cost relative to known bridges.

The principle and mode of operation of the invention have been described in its preferred embodiments. However, it should be noted that the invention described herein may be practiced otherwise than as specifically illustrated and described without departing from its scope.

What is claimed is:

1. An elongated girder for use in a bridge comprising:

a girder body having a modified V-shaped cross section, the body including:

longitudinally extending webs defining sides of the girder;

a bottom flange extending between the webs;

top flanges extending outwardly from the webs, wherein upwardly facing surfaces of the top flanges have a roughened surface configured to promote shear transfer; and strengthening material positioned in an interior of the girder at only the distal ends thereof to prevent crippling of the girder at a bridge abutment upon which the distal ends are placed, the strengthening material extending between the longitudinally extending webs, wherein the strengthening material is one of concrete, a plate of solid composite material, and a truss-type brace.

2. The elongated girder according to claim 1, wherein the top flanges have a corrugated surface.

3. The elongated girder according to claim 1, further including a plurality of shear connectors extending outwardly from the top flanges.

4. The elongated girder according to claim 3, wherein the shear connectors are bolts mounted in apertures formed in the top flanges.

5. The elongated girder according to claim 1, wherein each web is formed at an acute angle from a line extending perpendicularly from the bottom flange, and wherein the elongated girder is configured to be stacked and nested within another one of the elongated girders.

6. The elongated girder according to claim 5, wherein the girder body is formed from fiber reinforced polymer (FRP).

7. The elongated girder according to claim 5, wherein at least a portion of the webs have a sandwich type construction and are formed from a layer of one of foam and balsa between two layers of solid composite material, and wherein the bottom flange and the top flanges are formed from solid composite material.

8. The elongated girder according to claim 7, wherein the composite material is FRP.

9. A hybrid composite concrete bridge system comprising:

a plurality of elongated girders, each girder having a modified V-shaped cross section and including longitudinally extending webs defining sides of the girder, a bottom flange extending between the webs, top flanges extending outwardly from the webs, wherein upwardly facing surfaces of the top flanges have a roughened surface configured to promote shear transfer, and a plurality of shear connectors extending outwardly from the top flanges, wherein each girder is formed from fiber reinforced polymer (FRP), and wherein the plurality of girders are configured to be mounted between bridge abutments that define ends of a hybrid composite concrete bridge;

strengthening material positioned in an interior of the girders at only the distal ends thereof to prevent crippling of the girders at the bridge abutments upon which the distal ends are placed, the strengthening material extending between webs, wherein the strengthening material is one of concrete, a plate of solid composite material, and a truss-type brace; and a plurality of reinforced concrete deck panels configured for attachment to the girders, the reinforced concrete deck panels including pairs of parallel channels in a lower surface thereof, wherein the reinforced concrete deck panels are positioned on the girders such that the shear connectors on each of the top flanges are positioned inside one of the channels.

10. The hybrid composite concrete bridge system according to claim 9, wherein at least a portion of the webs have a sandwich type construction and are formed from a layer of one of foam and balsa between two layers of solid composite material, and wherein the bottom flange and the top flanges are formed from solid composite material.

11. The hybrid composite concrete bridge system according to claim 9, wherein the composite material is FRP.

12. The hybrid composite concrete bridge system according to claim 9, wherein when the concrete deck panels are attached to the girders, no portion of the concrete deck panels extend below the top flanges.

13. The hybrid composite concrete bridge system according to claim 9, wherein the top flanges are braced together with X-bracing in a horizontal plane.

14. The hybrid composite concrete bridge system according to claim 9, further including concrete grout within the parallel channels and about the shear connectors therein to further secure the concrete deck panels to the elongated girders, wherein the bridge system is configured to support a weight of the concrete deck panels prior to the concrete grout within the parallel channels being fully cured.

15. The hybrid composite concrete bridge system according to claim 9, wherein the shear connectors are steel bolts.

16. The hybrid composite concrete bridge system according to claim 15, wherein the top flanges are formed to have a bolt bearing strength sufficient to achieve composite action between the top flanges and the concrete deck panels.

17. The hybrid composite concrete bridge system according to claim 16, wherein the top flanges are formed to further have a combined bolt bearing strength that is also at least equal to a compressive strength of the plurality of reinforced concrete deck panels.

18. The hybrid composite concrete bridge system according to claim 15, wherein the upwardly facing surfaces of the top flanges have a corrugated surface, and wherein a combination of the corrugated surface and a clamping force from the steel bolts promotes shear transfer between each girder and the concrete deck panels.

19. A hybrid composite concrete bridge system comprising:

a plurality of elongated girders, each girder having a modified V-shaped cross section and including longitudinally extending webs defining sides of the girder, a bottom flange extending between the webs, top flanges extending outwardly from the webs, wherein upwardly facing surfaces of the top flanges have a roughened surface configured to promote shear transfer, and a plurality of shear connectors extending outwardly from the top flanges, wherein each girder is formed from fiber reinforced polymer (FRP), and wherein the plurality of girders are configured to be mounted between bridge abutments that define ends of a hybrid composite concrete bridge;

strengthening material positioned in an interior of the girders at only the distal ends thereof to prevent crippling of the girders at the bridge abutments upon which the distal ends are placed, the strengthening material extending between webs, wherein the strengthening material is one of concrete, a plate of solid composite material, and a truss-type brace; and a cast-in-place (CIP) reinforced concrete deck formed over one of removable and stay-in-place formwork positioned over the girders.

20. A method of forming a hybrid composite concrete bridge system comprising:

mounting a plurality of elongated girders between bridge abutments that define ends of a hybrid composite concrete bridge;

positioning strengthening material in an interior of the girders at only the distal ends thereof to prevent crippling of the girders at the bridge abutments upon which the distal ends are placed, the strengthening material extending between webs, wherein the strengthening material is one of concrete, a plate of solid composite material, and a truss-type brace; and attaching a plurality of reinforced concrete deck panels to the girders;

wherein each girder has a modified V-shaped cross section and includes longitudinally extending webs defining sides of the girder, a bottom flange extending between the webs, top flanges extending outwardly from the webs, wherein upwardly facing surfaces of the top flanges have a roughened surface configured to promote shear transfer, and a plurality of shear connectors extending outwardly from the top flanges, and wherein each girder is formed from fiber reinforced polymer (FRP);

wherein the reinforced concrete deck panels include pairs of parallel channels in a lower surface thereof, wherein the reinforced concrete deck panels are positioned on the girders such that the shear connectors on each of the top flanges are positioned inside one of the parallel channels;

wherein only one of a crane truck and a deck crane is used to perform each of the steps of positioning the elongated girders between the bridge abutments, positioning the concrete deck panels sequentially from an end of a bridge being formed by driving the one of a crane truck and a deck crane over previously installed concrete deck panels, and applying grout within the parallel channels and around the shear connectors.

21. The method according to claim 20, further including:

delivering the plurality of elongated girders to a bridge to the construction site in a stacked, nested configuration, such that 15 elongated girders may be stacked, nested and transported on one flatbed truck for the construction of between three and four bridge systems.

22. The method according to claim 20, further including the step of tightening the plurality of shear connectors to create a clamping force between the top flanges and the reinforced concrete deck panels.

* * * * *